United States Patent [19]

Ueberschaer

[11] Patent Number: 4,861,299

[45] Date of Patent: Aug. 29, 1989

[54] RESCUE LIFT

[76] Inventor: Hubert Ueberschaer, 110 Aston Ct., McMurray, Pa. 15317

[21] Appl. No.: 159,708

[22] Filed: Feb. 24, 1988

[51] Int. Cl.[4] ..... B63C 9/00

[52] U.S. Cl. ..... 441/80; 114/365

[58] Field of Search ..... 441/80, 83, 86, 87; 114/258, 259, 262, 44, 365, 373, 375, 376; 212/196

[56] References Cited

U.S. PATENT DOCUMENTS

| | | | |
|---|---|---|---|
| 194,123 | 8/1877 | Bourke | 114/373 |
| 208,360 | 9/1978 | Bamber | 441/80 |
| 600,355 | 3/1898 | Burton | 441/80 |
| 602,611 | 4/1898 | Agnew | 114/373 |
| 1,130,528 | 3/1915 | McGray | 441/80 |
| 1,163,553 | 12/1915 | Packer | 212/196 |
| 2,557,079 | 6/1951 | Cutri | 9/14 |
| 2,985,896 | 5/1961 | Lees | 9/14 |
| 3,796,281 | 3/1974 | Dowling | 182/48 |
| 3,942,655 | 3/1976 | Anderson | 114/373 |
| 4,271,553 | 6/1981 | Korsvik | 114/373 |
| 4,527,503 | 7/1985 | Connelly | 182/48 |
| 4,610,635 | 9/1986 | Austevoll | 441/80 |
| 4,678,446 | 7/1987 | Dahan | 441/80 |

FOREIGN PATENT DOCUMENTS

| | | | |
|---|---|---|---|
| 116839 | 1/1958 | U.S.S.R. | 441/80 |

*Primary Examiner*—Sherman D. Basinger
*Assistant Examiner*—Thomas J. Brahan
*Attorney, Agent, or Firm*—Buchanan Ingersoll; Michael L. Dever

[57] ABSTRACT

A rescue lift is provided wherein a frame supporting a rescue net is pivotally attached to a work boat by means of a rotating drive shaft positioned on the boat. A float is provided on the end of the frame opposite the drive shaft to enable the bottom of the net to be submerged in the sea at all times. The frame is free to rotate about its pivotal attachment as the ship rolls and pitches, thereby providing a safe means to rescue an incapacitated person in rough sea conditions. The drive shaft rotates the rescue lift between a pick-up position in the sea and a discharge position extending upwardly above the work boat. The rescue lift can be positioned in a stowed position in order to fully utilize the deck space of the ship.

12 Claims, 5 Drawing Sheets

RESCUE LIFT

BACKGROUND OF THE INVENTION

1. Field of the Invention

The present invention relates to a device for rescuing people or objects from the sea. More specifically, the present invention relates to a device which is particularly useful in rescuing incapacitated persons from the sea during severe weather conditions.

2. Description of the Prior Art

The need to rescue people or objects from the sea is a constant problem facing those who make their livelihood from the sea. Whether the person is a sailor on a ship, a construction worker building a bridge, or a crewman on an off-shore platform, anyone who works on or by the sea faces the possibility that he may need to be rescued from the sea. Oftentimes, the victim is incapacitated at the time of rescue, thereby requiring that special efforts and equipment be used to retrieve him.

It is customary to use a basket suspended from a derrick positioned on the deck of a vessel to rescue a victim from the sea. However, in heavy seas, when the vessel is rolling and pitching, it is not possible to effectively control the basket. With prior devices, the basket is often pulled out of the sea and then slammed back into the sea as the vessel rolls. Rescuing victims from the sea can become very difficult and even dangerous when the persons to be rescued are incapacitated.

Consequently, there is a need for a device which can rescue a person or persons from the sea who are unable to assist in the rescue effort. Furthermore, there is a need for a rescue device which will be as effective in severe weather conditions as in clear weather conditions.

SUMMARY OF THE INVENTION

In accordance with the present invention there is provided a frame means pivotally attached to the deck of a work boat. The frame means is adapted to rotate about the pivotal attachment from a first position extending outwardly into the sea to a second position extending upwardly from said boat. A netting means is provided upon the frame means to create a pocket having at least one opening sized to allow for entry of an object, such as a rescue victim, therein. A drive means rotates the frame means at least between the first position in the sea and the second position extending upwardly from the boat. A float means attached to said frame means provides buoyancy to the frame means. The float means is sized and positioned on the frame means to maintain a portion of the frame means submerged in the sea and to maintain a portion of the frame means out of the sea.

The combination of the float and hinged attachment of the frame to the deck of the boat allows the rescue lift to maintain its effectiveness in severe weather or rough sea conditions. The float, which will always be positioned at the top of the sea, permits only a portion of the net to be submerged A portion of the frame above the float is maintained above the sea at all times. The hinged attachment of the frame prevents the frame from pulling the net out of the sea as the boat rolls.

Once the object or rescue victim is within the net, an operator on the boat can complete the rescue by actuating a pair of hydraulic power cylinders, motor driven chain drive, or any other power unit, to rotate a main drive shaft. The rescue lift's frame is rigidly attached to the main drive shaft, which is in turn supported by three deck-mounted bearings. The slowly rotating main drive shaft will lift the frame out of the water into such a position which allows the boat's crew to take the victim out of the net or to have the victim slide out of the net onto a cushioned deck.

In order to reduce the size of the float and to reduce the force required to lift the frame with the person or persons to be rescued out of the water, the rescue lift has been provided with counterweights which are rigidly attached to the main drive shaft and positioned opposite the frame. This allows the float to be of considerably smaller size to support the frame, thereby reducing the wave and motion forces on the frame structure during pick-up operations.

Figure 1:
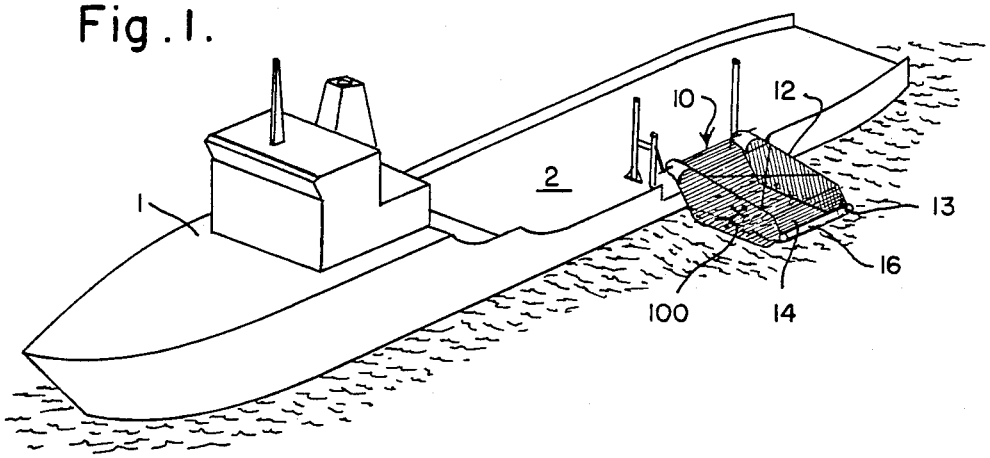
FIG. 1 is an isometric view of a presently preferred rescue lift of the invention as attached to a work boat.
Figure 6A:
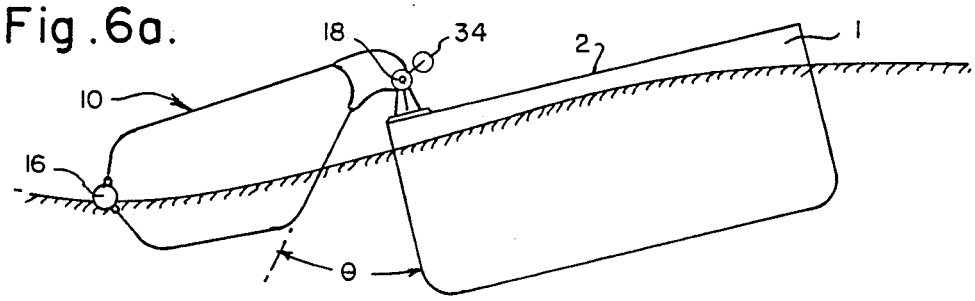
Figure 6B:
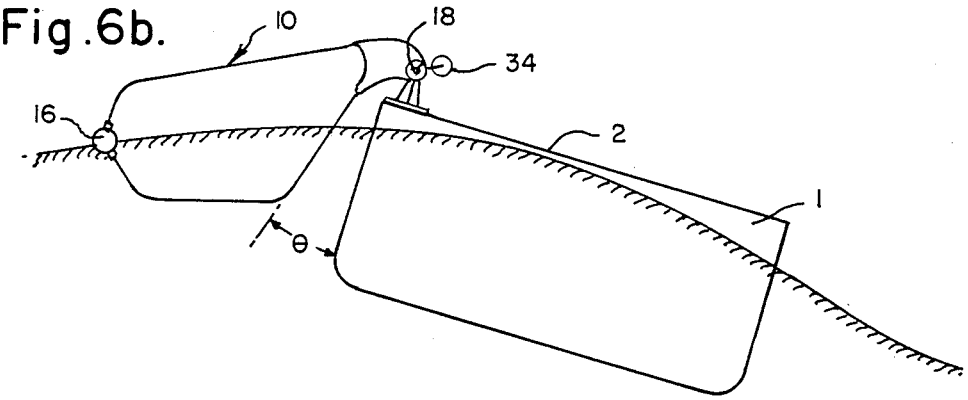
Figure 2:
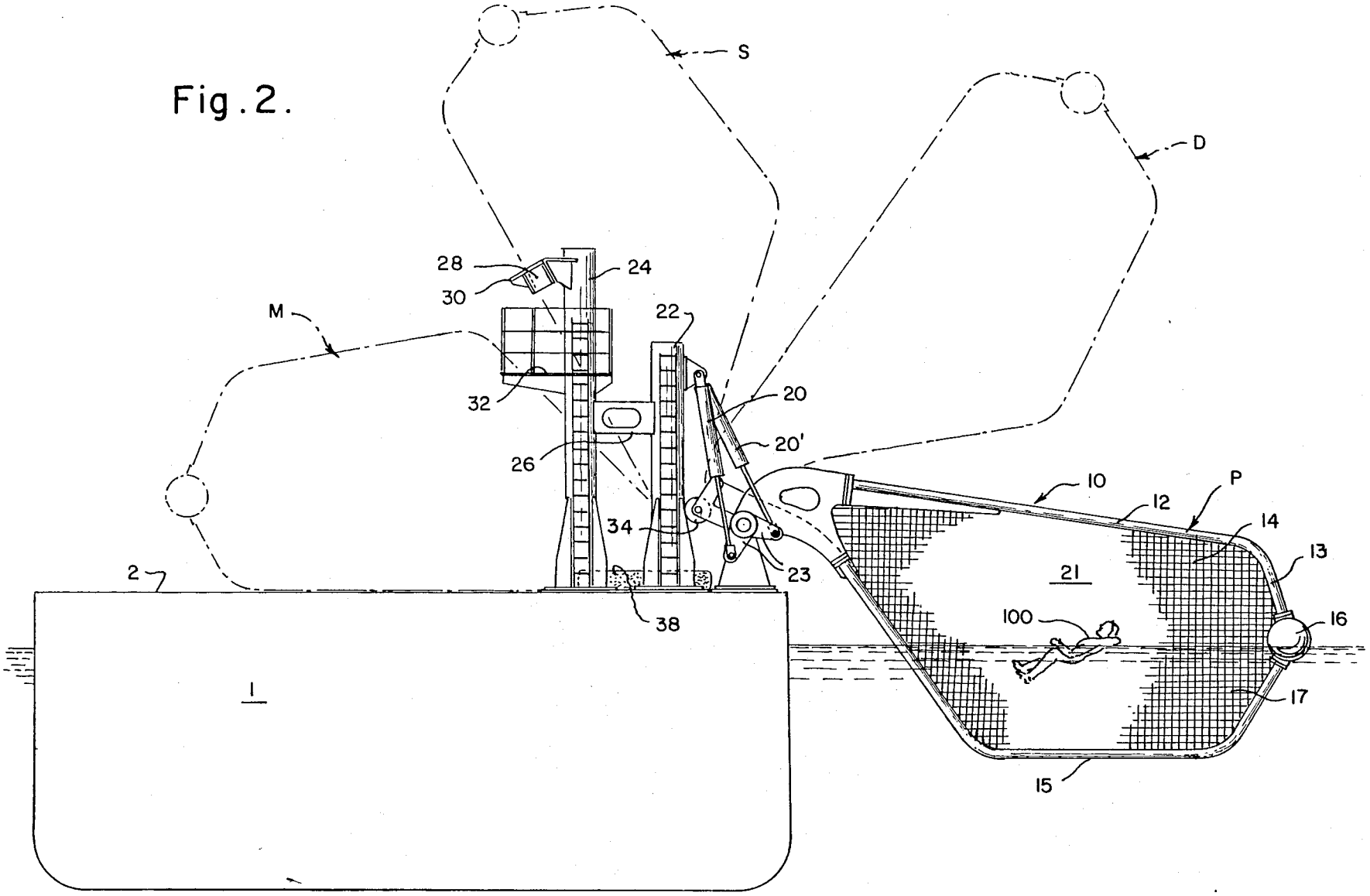
FIG. 2 is a front elevational view of a present preferred embodiment of the rescue lift of the invention showing the rescue lift in pick-up position, discharge position, stowed position, and maintenance position.

FIGS. *6a* and *6b* are schematic views showing the effect of rough sea conditions on the rescue lift of FIG. 2.

DESCRIPTION OF THE PREFERRED EMBODIMENTS

A shown in FIGS. 1 through 5, my rescue lift 10 is pivotally attached to the deck 2 of a work boat 1. The rescue lift 10 is adapted to receive and rescue at least one object such as person 100. The rescue lift includes a frame 12 upon which a net 14 is provided. A float 16 is positioned on an outer end 13 of the frame 12. The net 14 s positioned on the underside 15 of the frame 12, on the outer end 13 of the frame 12 above and below the float 16 and on the back 17 of the frame 12. There is no net provided on the forward side 19 of the frame 12 to permit the rescued person 100 to enter opening 21 of the rescue lift 10.

As shown in FIG. 2, the rescue lift 10 may be rotated to a number of set positions. Frame 12 is pivotally attached to deck 2 by means of a main drive shaft 18. The entire lift 10 may be rotated about shaft 18 by a pair of hydraulic cylinders 20 and 20' connected to drive shaft bracket 23. The cylinders 20 and 20' are supported by cylinder support mast 22. Cylinder support mast 22 is connected to frame support mast 24 through mast connecting bracket 26. A second frame support mast 24' is provided on the opposite side of the frame 12 from frame support mast 24.

FIG. 2 shows the rescue lift 10 in a pick-up position indicated as P. Person 100 has been received within the net 14 of frame 12. Once the person 100 is safely within opening 21 of the frame 12, an operator controls the hydraulic cylinders from the control console 39, shown in FIG. 3, to lift the frame 12 out of the sea. The frame rotates about drive shaft 18 until it has reached the discharge position shown indicated as D. In the discharge position, crew members can enter the rescue lift 10 to attend to person 100 situated therein. Alternatively, person 100 can exit the rescue lift 10 on his own if he is so able. Cushion 38, shown in FIG. 3, may be provided to assist in the removal of person 100 from rescue lift 10.

Once the rescue is complete, lift 10 can be further rotated until the frame 12 is in the stowed position indicated as S. In the stowed position, frame 12 encounters frame support cradles 28 and 28' provided on frame support masts 24 and 24', respectively. Frame fastening brackets 30 and 30' secure frame 12 to frame support cradles 28 and 28'. In this stowed position, rescue lift 10 does not interfere in any of the normal operations conducted on deck 2 of work boat 1. Working platforms 32 and 32' are provided to give the crew access to the frame support cradles 28 and 28' for securing the frame 12 to the frame support masts 24 and 24' and to free frame 12 from the frame support cradles 28 and 28' for rescue operations.

If rescue lift 10 needs repair work, frame support cradles 28 and 28' can be moved sideways and out of the way of frame 12. Lift IO can then be further rotated until the frame 12 is in the maintenance position indicated as M.

Float 16 must be sized to provide sufficient buoyancy to the rescue lift 10. In order to reduce the size of the float 16, counterweights 34 are preferably provided opposite frame 12 on the main drive shaft 18. Counterweight 34 reduce the size of the float 16 and thereby reduce the forces which act on the frame structure during the pick-up operation. Counterweights 34 also reduce the force needed to rotate drive shaft 18 to lift frame 12 out of the sea.

Preferably, a disc brake 36 is secured to deck 2 of work boat 1 and disc 37 is attached to drive shaft 18. Disc brake 36 may be selectively brought into frictional engagement with disc 37 attached to drive shaft 18. Disc brake 36 can be used when the rescue lift 10 is in the discharge position, after the rescue lift 10 has been brought into the stowed position prior to securing frame 12 to frame support masts 24 and 24', and after the rescue lift 10 has been rotated completely to the maintenance position. Furthermore, disc brakes 36 can also be used to dampen the movement of the rescue lift 10 during rescue operations and at times of extreme wave and boat motions.

Figure 3:
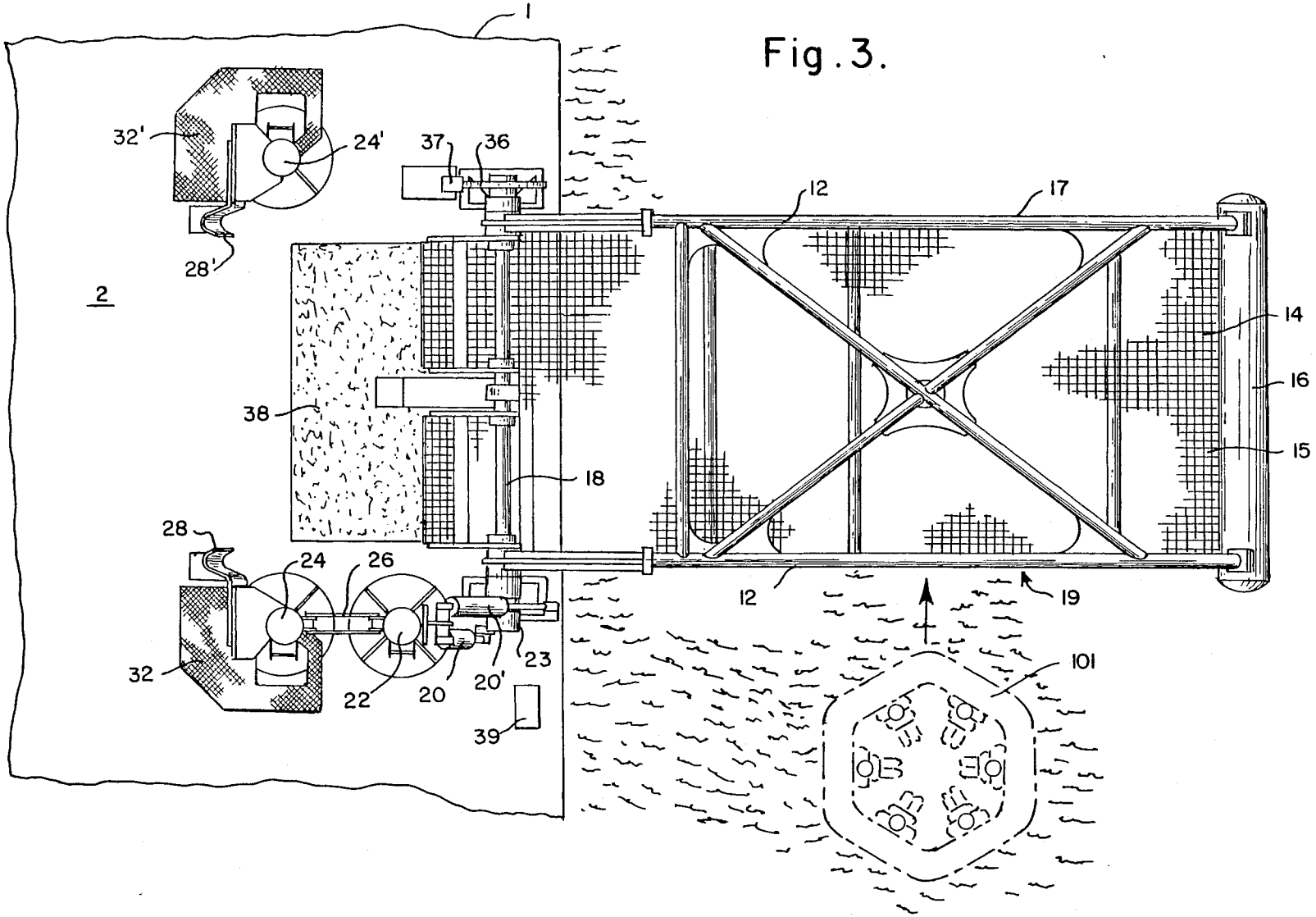
FIG. 3 is a top view of the rescue lift of FIG. 2.
Figure 4:
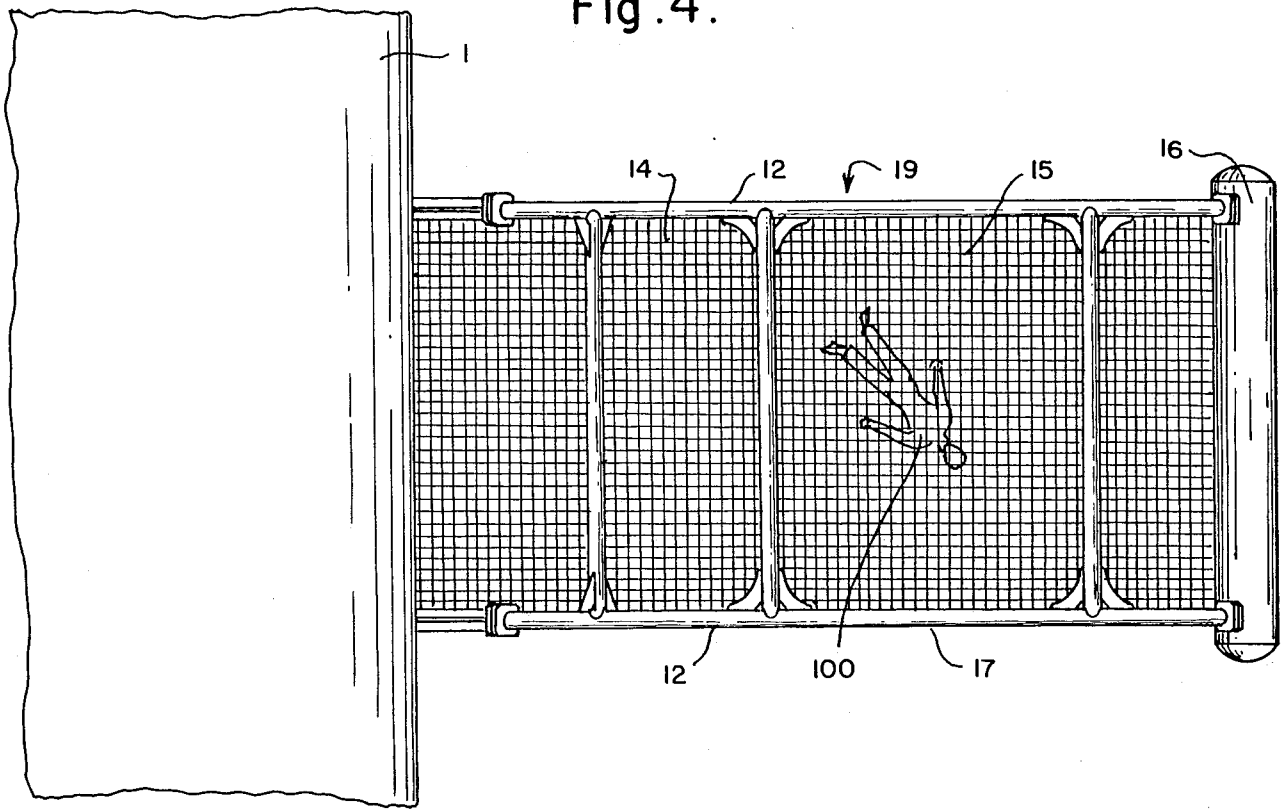
FIG. 4 is a bottom view of the rescue lift of FIG. 2.
Figure 5:
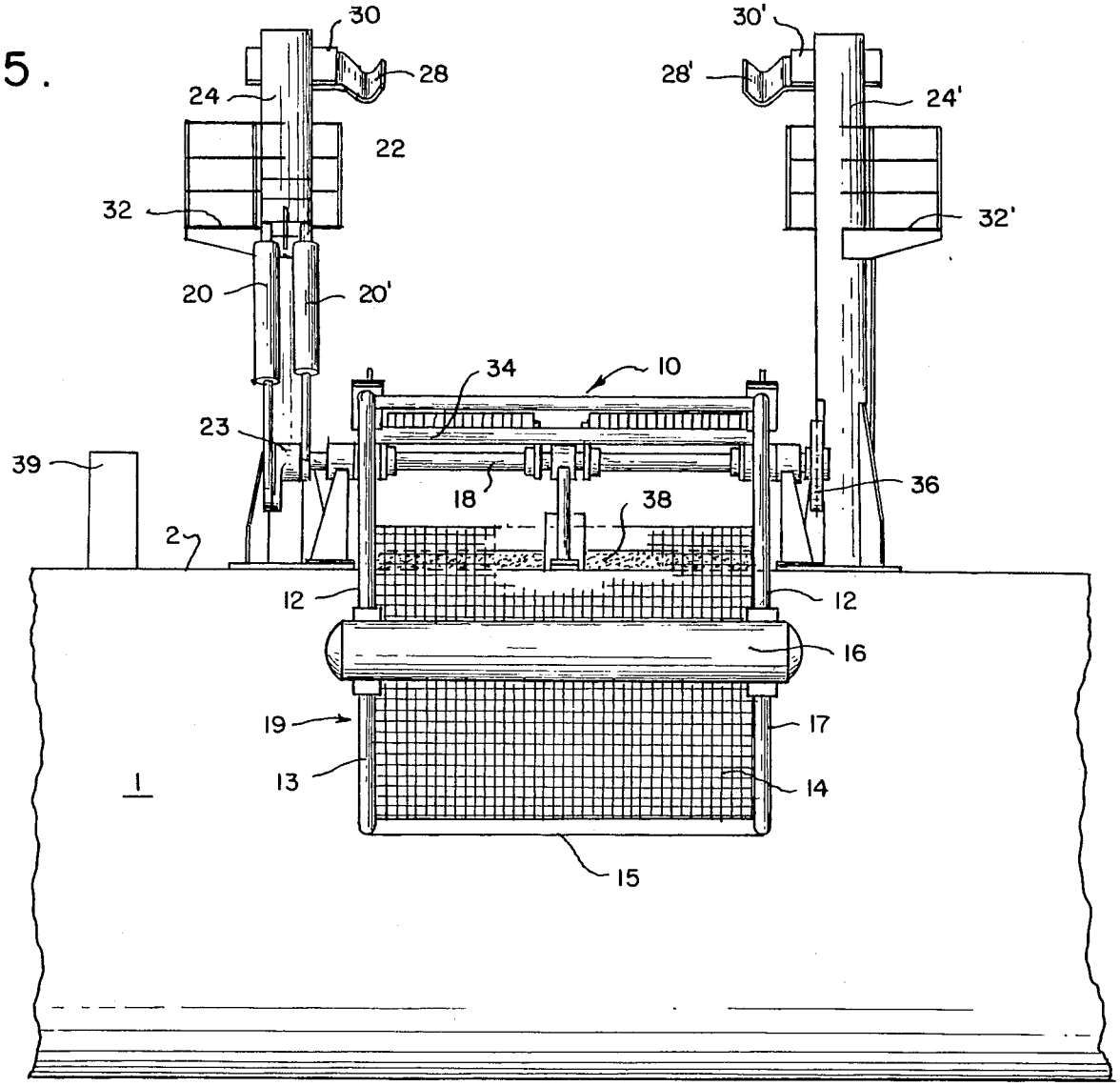
FIG. 5 is a side elevational view of the rescue lift of FIG. 2.

Preferably, frame 12 is sized such that more than one person 100 can be rescued in a single operation. As shown in FIG. 3, frame 12 can be sized to accept a life raft 101 containing up to 10 persons. By use of such a strong frame 12, rescue lift 10 can more efficiently rescue a large number of persons from the sea. Additionally, rescue lift 10 is adapted to retrieve inanimate objects which may be floating on or near the surface of the sea.

By using the combination of float 16 and hinged attachment of the frame 12 to the main drive 18, rescue lift can maintain its effectiveness in severe weather or rough sea conditions As shown in FIGS. *6a* and *6b*, , float 16 permits only a portion of the net 14 to be submerged. That portion of the frame 12 above float 16 is maintained above the sea at all times. The pivotal attachment of frame 12 to main drive shaft 18 prevents the frame 12 from pulling the net out of the sea and plunging the frame 12 into the sea as the boat rolls. Instead, the frame 12 can rotate through a wide variety of angles $\theta$ with respect to boat 1. The pivotal attachment permits frame 12 to rotate about drive shaft 18 in order to operate effectively in severe weather conditions.

In operation, the rescue lift 10 is positioned in the pick-up position P of FIG. 2. The work boat 1 is directed toward the person 100 or life boat 101. The person 100 enters the forward side 19 of frame 12 and is caught within opening 21 by net 14. Once person 100 is safely positioned within net 14, the rescue lift 10 is rotated to discharge position D.

Although I have disclosed a drive power system using hydraulic cylinders 20 and 20', it is to be understood that motor driven chain drives or any other power unit can also be used to rotate drive shaft 18 to raise and lower frame 12. Furthermore, it is to be understood that the use of the word object herein to describe what is retrieved by rescue lift 10 encompasses all objects, inanimate as well as animate.

While I have described certain presently preferred embodiments of my invention, it is to be distinctly understood that the invention is not limited thereto and may be otherwise variously practiced within the scope of the following claims.

I claim:

1. A rescue apparatus for use on a boat to retrieve at least one person or object from the sea comprising:

(a) frame means pivotally attached to said boat, said frame means comprising an upper portion and a lower portion, said upper portion and lower portion connected along first and second opposite sides of said frame means, a forward portion on a side of said frame means in which said boat moves and a back portion opposite said forward portion, said frame means having a pivotal attachment along said first side adapted to rotate said frame means from a first position extending into the sea to a second position extending upwardly from said boat;

(b) netting means attached to and covering said frame means creating a pocket having at least one opening sized to allow for entry of an object, said netting means provided on the upper portion, lower portion, and back portion of said frame means, and not on the forward portion of said frame means;

(c) drive means for rotating said frame means at least between said first position and said second position; and (d) float means attached to said upper portion and said lower portion of said frame means on the second side of said frame means, wherein said float means provides buoyancy to the frame means, said float means positioned on said frame means to maintain said lower portion of said frame means generally submerged in the sea and to maintain said upper portion of said frame means generally out of the sea.

2. The apparatus of claim 1 further comprising counterweights provided on said drive means opposite said frame means.

3. The rescue apparatus of claim 1 wherein said drive means comprises: (a) a drive shaft solidly attached to said frame means; (b) at least one hydraulic cylinder adapted to rotate said drive shaft; and (c) means to attach said at least one hydraulic cylinder to said drive shaft.

4. The rescue apparatus of claim 3 wherein a pair of hydraulic cylinders are connected to a bracket which is connected to said drive shaft.

5. The rescue apparatus of claim 1 further comprising frame support masts adapted to secure said frame means in a stowed position.

6. The rescue apparatus of claim 1 wherein said netting means is adapted to accept a life raft.

7. The rescue apparatus of claim 1 further comprising braking means provided on said drive means, said braking means adapted to lock the frame means in a set position and to dampen the rotation of the frame means about the pivotal attachment.

8. A rescue apparatus for use on a boat to retrieve at least one person or object from the sea comprising;

(a) frame means pivotally attached to said boat, said frame means comprising an upper portion and a lower portion, said upper portion and lower portion connected along first and second opposite sides of said frame means, a forward portion on a side of said frame means in which said boat moves and a back portion opposite said forward portion, said frame means having a pivotal attachment along said first side adapted to rotate said frame means from a first position extending into the sea to a second position extending upwardly from said boat;

(b) netting means attached to and covering said frame means creating a pocket having at least one opening sized to allow for entry of an object, said netting means provided on the upper portion, lower portion, and back portion of said frame means, and to on the forward portion of said frame means; and (c) float means attached to said upper portion and said lower portion of said frame means on the second side of said frame moans wherein said float means provides buoyancy to the frame means, said float means positioned on said frame means to maintain said lower portion of said frame means generally submerged in the sea and to maintain said upper portion of said frame means generally out of the sea.

9. The rescue apparatus of claim 8 further comprising drive means for rotating said frame means at least between said first position and said second position.

10. The rescue apparatus of claim 9 further comprising counterweights provided on said drive means opposite said frame means.

11. A rescue apparatus for use on a boat to retrieve at least one person or object from the sea comprising:

(a) frame means pivotally attached to said boat, said frame means adapted to rotate about said pivotal attachment from a first position extending outwardly into the sea to a second position extending upwardly from said boat, said frame means comprising an upper portion and a lower portion, said upper portion and lower portion connected along a first side of said frame means;

(b) netting means attached to and covering said frame means creating a pocket having at least one opening sized to allow for entry of an object;

(c) drive means for rotating said frame means at least between said first position and said second position, said drive means comprising a drive shaft solidly attached to said frame means and a pair of hydraulic cylinders connected to a bracket which is connected to said drive shaft;

(d) float means attached to said upper portion and said lower portion of said frame means on a second side of said frame means opposite said first side wherein said float means provides buoyancy to the frame means, said float means positioned on said frame means to maintain said lower portion of said frame means generally submerged in th sea and to maintain said upper portion of said frame means generally out of the sea;

(e) braking means provided on said drive means, said braking means adapted to lock the frame means in a set position and to dampen the rotation of the frame means about the pivotal attachment;

(f) counterweights provided on said drive means opposite said frame means; and (g) frame support masts adapted to secure said frame means in a stowed position.

12. The rescue apparatus of claim 11 wherein said frame means further comprises a forward portion on the side of the float means in which said boat moves and a back portion opposite said forward portion; and said netting means is provided on the upper portion, lower portion, and back portion of said frame means.

* * * * *

UNITED STATES PATENT AND TRADEMARK OFFICE

CERTIFICATE OF CORRECTION

PATENT NO. : 4,861,299

DATED : August 29, 1989

INVENTOR(S) : HUBERT UEBERSCHAER

It is certified that error appears in the above-identified patent and that said Letters Patent is hereby corrected as shown below:

Column 2, line 41, change "s" to --is--.

Column 3, line 20, change "IO" to --10--.

Column 4, line 54, Claim 2, after "The" insert --rescue--.

Column 5, line 31, Claim 8, change "moans" to --means--.

Column 6, line 26, Claim 11, change "th" to --the--.

Signed and Sealed this

Seventh Day of August, 1990

*Attest:*

HARRY F. MANBECK, JR.

*Attesting Officer*

*Commissioner of Patents and Trademarks*